US006326735B1

(12) United States Patent
Wang et al.

(10) Patent No.: US 6,326,735 B1
(45) Date of Patent: Dec. 4, 2001

(54) LONG-LIFE TYPE COLORFUL ELECTROLUMINESCENT DISPLAY PANEL

(75) Inventors: Shaw-Jong Wang, Hsinchu; Chi-Jung Shen, Taipei, both of (TW)

(73) Assignee: Ritek Corporation (TW)

( * ) Notice: Subject to any disclaimer, the term of this patent is extended or adjusted under 35 U.S.C. 154(b) by 0 days.

(21) Appl. No.: 09/624,354

(22) Filed: Jul. 24, 2000

(30) Foreign Application Priority Data

Feb. 3, 2000 (CN) ..... 89202163 U

(51) Int. Cl.[7] ..... G09G 3/10
(52) U.S. Cl. ..... 315/169.3; 313/510
(58) Field of Search ..... 315/169.3, 160; 345/45, 76; 313/494, 510, 516, 517; 362/124, 808, 812

(56) References Cited

U.S. PATENT DOCUMENTS 3,548,254 * 12/1970 Pahlavan ..... 315/169
3,566,391 * 2/1971 Lally ..... 340/336
3,573,532 * 4/1971 Boucher ..... 315/169.3
4,135,959 * 1/1979 Luo et al. ..... 156/230
4,853,594 * 8/1989 Thomas ..... 313/503
4,963,788 * 10/1990 King et al. ..... 313/503
5,444,330 * 8/1995 Leventis et al. ..... 313/506
5,712,528 * 1/1998 Barrow et al. ..... 313/506
5,902,688 * 5/1999 Antoniadis et al. ..... 428/690
5,965,980 * 10/1999 Hagiwara et al. ..... 315/169.3
6,034,481 * 3/2000 Haynes ..... 345/76
6,054,725 * 4/2000 Liedenbaum et al. ..... 313/510
6,144,156 * 11/2000 Lutschounig et al. ..... 313/494

* cited by examiner

*Primary Examiner*—Don Wong
*Assistant Examiner*—Thuy Vinh Tran
(74) *Attorney, Agent, or Firm*—Finnegan, Henderson, Farabow, Garrett & Dunner, L.L.P.

(57) ABSTRACT

A long-life type colorful electroluminescent (EL) display panel is disclosed. The EL display panel comprises a luminescent laminate, two electrodes located at the two sides of the luminescent laminate, several terminals, and a display surface. One of the two electrodes includes plural separated sub-electrodes. Each sub-electrode comprises at least one branch portion and a bus bar connecting at least one branch portion to one of the terminals. Each of the branch portions in one sub-electrode is accompanied with one branch portion in a sub-electrode different from the one sub-electrode, and extends in parallel thereto in a position corresponding to a portion of the display surface which is representative of substantially the same area. By means of the above structure, the display panel will have a life span more than double the normal and can display colorfully.

12 Claims, 3 Drawing Sheets

LONG-LIFE TYPE COLORFUL ELECTROLUMINESCENT DISPLAY PANEL

BACKGROUND OF THE INVENTION

1. Field of the Invention

This invention relates to a long-life type colorful electroluminescent (EL) display panel and more particularly to an EL display panel that has an electrode structure capable of increasing life span and making the display panel colorful.

2. Description of the Prior Art

It is well known that the so-called electroluminescent (EL) display panel mainly comprises a transparent substrate, a transparent electrode formed on the transparent substrate, a luminescent laminate, and a biasing electrode formed on the luminescent laminate opposite to the transparent electrode. Moreover, a display surface is usually arranged on the surface of the transparent substrate opposite to the transparent electrode. The display surface is usually provided with a pattern.

However, the EL display panel has a specific life span. In case the EL display panel is broken down, a replacement with a new EL display panel could be necessary. However, a procedure for such a replacement is more or less troublesome. Thus, how to increase the life span of the EL display panel would be a project.

Moreover, in terms of a specific pattern in an EL display panel, usually only one color can be presented. Such a display with respect to the pattern is more or less monotonous.

SUMMARY OF THE INVENTION

An object of this invention is to provide an electroluminescent display panel having a life span longer than that of a conventional EL display panel.

The other object of this invention is to provide an electroluminescent display panel capable of presenting a colorful pattern.

To achieve the above objects, an electroluminescent display panel according to the present invention comprises a luminescent laminate, two electrodes located at the two sides of the luminescent laminate, several terminals respectively connected to the two electrodes, and a display surface at one side of one of the two electrodes opposite to the luminescent laminate, and is characterized in that one of the two electrodes includes plural separated sub-electrodes, each sub-electrode comprises at least one branch portion and a bus bar connecting at least one branch portion to one of the terminals, each of the branch portions of the sub-electrodes is accompanied with one branch portion in a different sub-electrode and extends in parallel thereto in a position corresponding to a portion of the display surface which is representative of substantially the same area.

By means of the above structure, since each sub-electrode has one branch portion extending to a position corresponding to a portion of the display surface which is representative of substantially the same area, i.e., substantially the same area can present light by means of the plural sub-electrodes, as well as their respectively corresponding luminescent material, which are actuated one by one, the life span of the EL display panel will increase. Moreover, if the plural sub-electrodes are actuated by electric powers at different frequencies, substantially the same area will present plural colors, and thus a colorful EL display panel is obtainable. Furthermore, if each sub-electrode is actuated one by one at a specific time interval, substantially the same area will present an effect like a neon lamp. Further, if the colors of the lights each emitted by the luminescent material corresponding to one of the sub-electrodes are different, the neon effect will be more colorful.

The advantages and features of this invention can be easily comprehended by persons skilled in the art through the drawings and following detailed explanations.

DETAILED DESCRIPTIONS OF EMBODIMENTS

Figure 1:
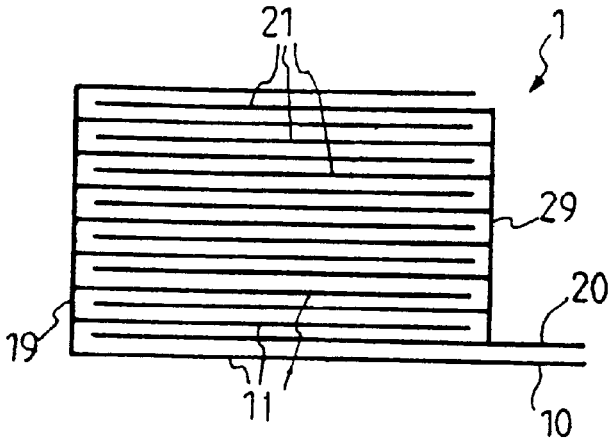
FIG. 1 illustrates a schematic plan view of one of the electrodes of an EL display panel according to the first embodiment of this invention.

Referring now to the drawings, preferred embodiments of the present invention will be explained.

FIG. 1 illustrates a schematic plan view of one of the electrodes of an EL display panel according to the first embodiment of this invention. One of the electrodes can be either a biasing electrode or a transparent electrode. As shown in FIG. 1, the electrode 1 comprises a first sub-electrode 10 and a second sub-electrode 20. The first sub-electrode 10 includes a group of separated branch portions 11 in parallel formation extending in a specific area and a bus bar 19 connecting each branch portion 11 to a first terminal (no shown). The second sub-electrode 20 includes a group of branch portions 21, parallel to each other, extending in an area substantially identical to the aforesaid specific area and a bus bar 29 connecting each branch portion 21 to a second terminal (not shown). Each pair of the branch portions 11 in the first sub-electrode 10 are interleaved with one branch portion 21 in the second sub-electrode 20. All the branch portions 11 in the first sub-electrode 10 are combined by the bus bar 19 on one side opposite to the bus bar 29 by which the branch portions 21 of the second sub-electrode 20 are combined.

According to the configuration shown in FIG. 1, since the first sub-electrode 10 and the second sub-electrode 20 spread over substantially the same area via a plurality of separate strip-like branch portions and since each pair of the branch portions of the first sub-electrode 10 are interleaved with one branch portion of the second sub-electrode 20, the two sub-electrodes 10 and 20 could be deemed to be located at substantially the same lighting area. Thus, if the portion of the luminescent laminate corresponding to the first sub-electrode 10 is expired, the second sub-electrode 20 which is located in substantially the same lighting area could be actuated so as to excite substantially the same lighting area. Consequently, the life span of the EL display panel could double and the display panel is still available.

Moreover, as an application example of the electrode structure shown in FIG. 1, the first sub-electrode 10 can be biased by an electric power at a first frequency while the second sub-electrode 20 can be biased by an electric power at a second frequency different to the first frequency. In such a case, since the luminescent laminate can luminesce with different colors based upon the frequencies of the electric powers to be applied, the luminescing light of the EL display panel will be colorful if the two sub-electrodes 10 and 20 are simultaneously or succeedingly biased by the two electric powers of different frequencies. For example, the light of a yellow color or of a red color can be simultaneously or succeedingly generated. Therefore, by means of the electrode structure of this invention, a colorful EL display panel would be obtainable. However, if the two sub-electrodes 10 and 20 are biased by the same electric power with the same frequency, while the areas of the luminescent laminate respectively corresponding to the first and the second sub-electrodes 10 and 20 are constructed by different luminescent material respectively emitting lights of different colors, a colorful EL display panel is also obtainable. Furthermore, each of the first and the second sub-electrodes 10 and 20 has only one branch portion so as to present a line pattern represented in substantially the same area.

Figure 2:
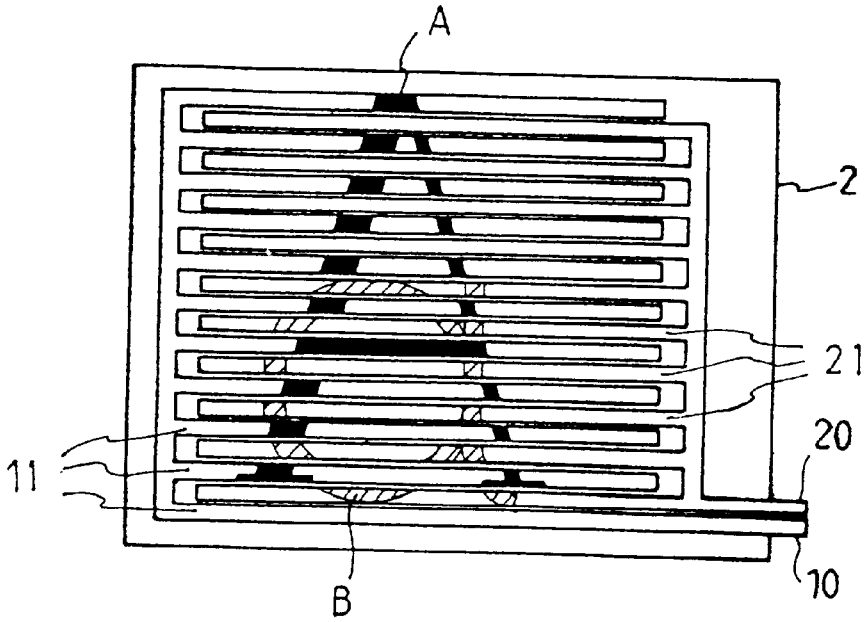
FIG. 2 illustrates a schematic plan view of the electrode structure in FIG. 1 incorporated with a display surface having two patterns in substantially the same area.

FIG. 2 illustrates a schematic plan view of the electrode structure shown in FIG. 1 incorporated with a display surface having two patterns in substantially the same area. According to the embodiment in FIG. 2, substantially the same area of the display surface 2 of the EL display panel contains a first pattern A (shown as "A") and a second pattern B (shown as "a") which overlap in terms of substantially the same area but offset in terms of each pattern element thereof. In detail, each of the first pattern A and the second pattern B is composed of a group of separated longitudinal pattern segments in parallel, and each pair of the pattern segments in one group are interleaved with one pattern segment in the other group. Moreover, the branch portions 11 of the first sub-electrode 10 respectively correspond to the pattern segments of the first pattern A while the branch portions 21 of the second sub-electrode 20 respectively correspond to the pattern segments of the second pattern B. By means of the above arrangement, the place corresponding to the first pattern A, which presents the pattern of "A", will light when the first sub-electrode 10 is actuated, and the place corresponding to the second pattern B, which presents the pattern of "a", will light if the second sub-electrode 20 is actuated. However, it is comprehensible that the patterns A and B could be any proper patterns such as "welcome" and "thank you" respectively. Thus, different indicators could be displayed in substantially the same area based upon different situations.

Figure 3:
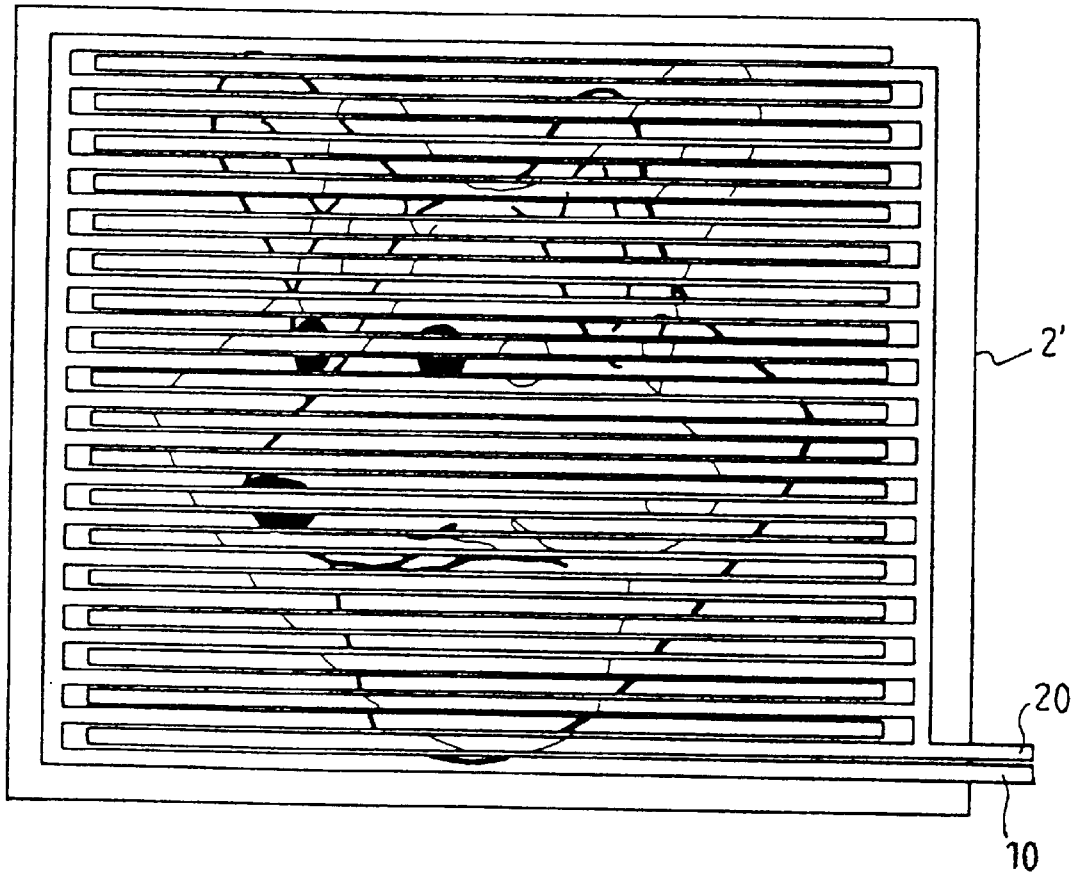
FIG. 3 illustrates a schematic view similar to FIG. 2 except for the two patterns.

Moreover, the patterns A and B could be two related patterns such as those shown in FIG. 3 which show dog heads of facing different directions respectively. In this case, if the first sub-electrode 10 and the second sub-electrode 20 are alternatively actuated, the display surface 2' will present a swing action of the dog head. Furthermore, based upon the aforesaid case, if there are many sets of the patterns including the patterns A and B in the display surface as well as their corresponding sub-electrodes, a continuously changing effect like animation could be obtainable if such sub-electrodes are actuated in sequence.

In the above case in which the two patterns are alternatively displayed, a diffusion plate (not shown) can be disposed on the display surface 2 or 2' so as to smooth the lines in each pattern.

The above structure relates to a situation where the branch portions and the bus bar of each sub-electrode are located at a same laminating level. However, the branch portions and the bus bar can be disposed at different laminating levels as illustrated in the following embodiment in which the quantity of the sub-electrodes could be more than two.

Figure 4:
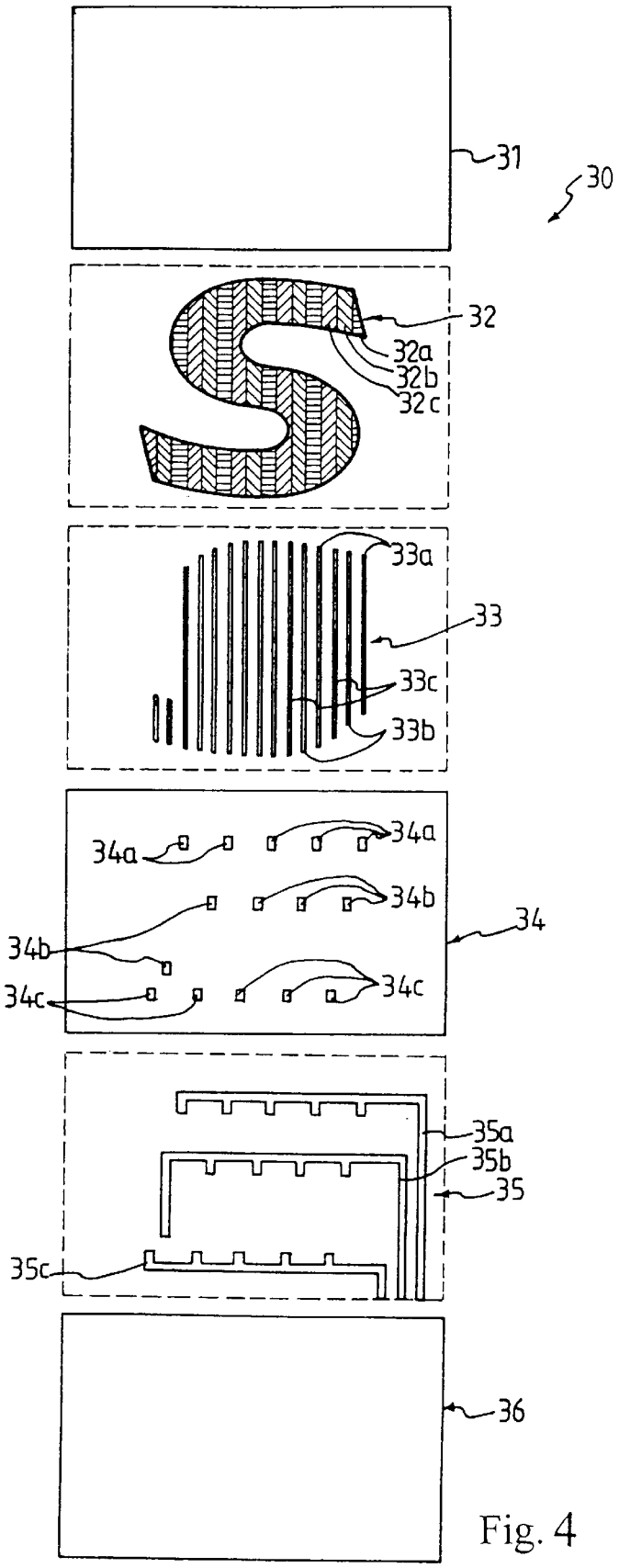
FIG. 4 illustrates an exploded schematic view of the EL display panel according to the second embodiment of this invention.

FIG. 4 shows an exploded schematic view of the EL display panel according to the second embodiment of this invention. As shown in FIG. 4, the EL display panel 30 according to the second embodiment of this invention mainly comprises a transparent laminate 31 including a transparent substrate and a transparent electrode, a luminescent laminate 32, a biasing electrode laminate including a branch layer 33, an insulating layer 34, and a bus bar layer 35, and a protecting layer 36, all of them being laminated in sequence.

The luminescent laminate 32 is constructed by three kinds of materials 32*a*, 32*b*, and 32*c*, each being capable of emitting a specific color under bias. Each kind of luminescent material is divided into a plurality of pattern segments parallel to each other. Each pair of pattern segments in the same kind of luminescent material, for example 32*a*, are interleaved with one pattern segment of the other two kinds of luminescent materials, for example 32*b* and 32*c*. The biasing electrode laminate includes three sub-electrodes. The three sub-electrodes respectively comprise plural branch portions 33*a*, 33*b*, 33*c* located in the branch layer 33, plural vias 34*a*, 34*b*, 34*c* located in the insulating layer 34, and a bus bar 35*a*, 35*b*, 35*c* located in the bus bar layer 35. Like the arrangement of the three kinds of luminescent materials in this embodiment, each pair of branch portions of each sub-electrode, for example 33*a*, are interleaved with one branch portion of the other two sub-electrodes such as 33*b* and 33*c* such that all branch portions respectively belonging to the three sub-electrodes are distributed at substantially the same area of the display surface, such as the pattern of "S" and that each branch portion corresponds to one pattern segment.

Moreover, the insulating layer 34 is formed with many vias which are separated into three sets 34*a*, 34*b*, and 34*c*. Each via corresponds to one branch portion that belongs to the sub-electrode corresponding to the set of the via.

The bus bar layer 35 is laminated on the insulating layer 34 and includes three bus bars 35*a*, 35*b*, and 35*c* constructed by silver glue, each belonging to one sub-electrode and being connected to one terminal (not shown). Each bus bar, for example 35*a*, can be connected to its corresponding branch portion, for example 33*a*, belonging to a same sub-electrode, through the corresponding via, for example 34*a*, so as to supply electric power to each branch portion, for example 33*a*. Moreover, the bus bar layer 35 can be constructed by any proper conductive material in addition to the silver glue. The protecting layer 36 is laminated over the whole biasing electrode laminate so as to protect the biasing electrode. However, it is optional.

By means of the above structure in the second embodiment of this invention, substantially the same area could contain an arbitrary number of sub-electrodes, and such sub-electrodes can be biased by any measure illustrated in the above.

Furthermore, it is comprehensible that each of the branch portions illustrated in the second embodiment can be of a circle shape or a dot. They can be supplied with electric power group by group by the bus bars respectively. Thus, by virtue of the arrangement of such dots, the presented pattern would be more smooth and colorful.

From the embodiments of this invention thus described, it will be obvious that the present invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electroluminescent display panel comprising a luminescent laminate, two electrodes located at the two sides of the luminescent laminate, a plurality of terminals, each being connected to the two electrodes, and a display surface at one side of one of the two electrodes opposite to the luminescent laminate, wherein one of the two electrodes includes a plurality of separated sub-electrodes, each sub-electrode comprising a bus bar and at least one branch portion connected by the bus bar to one of the terminals, and each of the branch portions being accompanied with one branch portion of a different sub-electrode and extending in parallel thereto in a position corresponding to a portion of the display surface which is representative of substantially the same area.

2. The electroluminescent display panel of claim 1, wherein substantially the same area is provided with one pattern and each of the branch portions of each sub-electrode extends in an area corresponding to the pattern.

3. The electroluminescent display panel of claim 2, wherein substantially the same area is provided with a plurality of patterns, each of the patterns being divided into a group of separated longitudinal pattern segments in parallel and each of the pattern segments in one group thereof being accompanied in parallel with one in the other group of pattern segments, and wherein each of the branch portions in one sub-electrode extends in a position corresponding to one of the group of the pattern segments which corresponds to the sub-electrode.

4. The electroluminescent display panel of claim 2, wherein each branch portion is in the form of a dot.

5. The electroluminescent display panel of claim 1, wherein the sub-electrodes are respectively actuated by electric power at different frequencies.

6. The electroluminescent display panel of claim 5, wherein the sub-electrodes are simultaneously actuated by different electric powers respectively.

7. The electroluminescent display panel of claim 1, wherein the sub-electrodes are alternatively actuated by the same electric power.

8. The electroluminescent display panel of claim 1, further comprising a diffusion sheet overlapping the pattern provided in the display surface.

9. The electroluminescent display panel of claim 1, wherein one of the two electrodes is a biasing electrode.

10. The electroluminescent display panel of claim 1, wherein one of the two electrodes is a transparent electrode.

11. The electroluminescent display panel of claim 1, wherein all the branch portions of the sub-electrodes and the bus bars thereof are located at the same laminating level.

12. The electroluminescent display panel of claim 1, wherein all the branch portions of the sub-electrodes and the bus bars thereof are located at different laminating levels and are interleaved with an insulating layer at the individual crossing of the branch portions and the bus bars.

* * * * *